United States Patent [19]

Graziano

[11] Patent Number: 4,952,184

[45] Date of Patent: Aug. 28, 1990

[54] CROSS-WATER SKI

[76] Inventor: Maria G. Graziano, 5325 Noyes Ave., Apt. 4, Charleston, W. Va. 35304

[21] Appl. No.: 341,914

[22] Filed: Apr. 24, 1989

[51] Int. Cl.[5] ..... A63C 15/03

[52] U.S. Cl. ..... 441/77

[58] Field of Search ..... 441/65, 76, 77, 70; 440/101; 280/614, 615

[56] References Cited

U.S. PATENT DOCUMENTS

| | | | |
|---|---|---|---|
| 1,834,424 | 12/1931 | Rohrmann et al. | 441/77 |
| 3,031,696 | 5/1962 | Brabb | 44/77 |
| 3,063,071 | 11/1962 | Van Vorst | 441/77 |
| 3,112,504 | 12/1963 | Carlton | 44/77 |
| 3,134,114 | 5/1964 | Stimm | 441/77 |
| 3,242,898 | 3/1966 | Livaudais | 441/77 |
| 4,599,072 | 7/1986 | Pollini et al. | 441/76 |

FOREIGN PATENT DOCUMENTS

| | | | |
|---|---|---|---|
| 2937347 | 6/1980 | Fed. Rep. of Germany | 280/615 |
| 2338723 | 8/1977 | France | 441/77 |

*Primary Examiner*—Joseph F. Peters, Jr.
*Assistant Examiner*—Jesus D. Sotelo
*Attorney, Agent, or Firm*—Beveridge, DeGrandi & Weilacher

[57] ABSTRACT

A cross-water ski for walking on water having a buoyant member with flaps rotatably attached to its bottom surface and stoppers to prevent movement of the flaps when they reach a position perpendicular to the bottom surface of the buoyant member. The flaps rotate from a low water resistance position when the ski is moved forward along the surface of the water to a perpendicular, high water resistance position when the ski is moved rearward. The cross-water ski also includes a foot piece which releasably locks the user's shoe to the buoyant member but allows the user to repeatedly flex his or her foot as the skis are moved forwardly and rearwardly. In addition, a central fin is provided which is free to move upon contact with obstacles below the surface of the water.

21 Claims, 3 Drawing Sheets

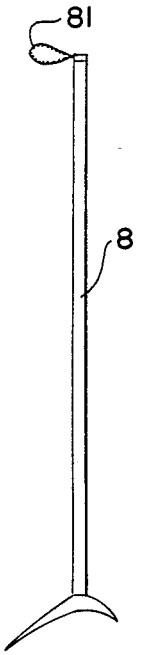
FIG. 7
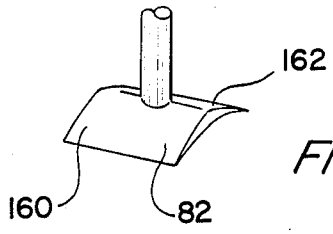
FIG. 7A
FIG. 8
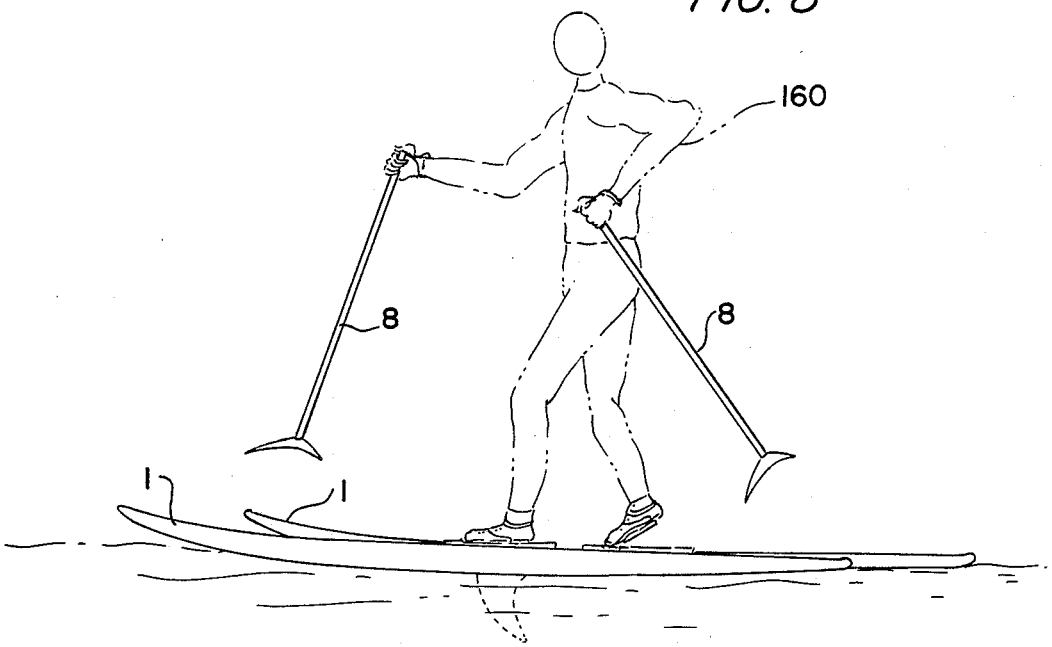

CROSS-WATER SKI

BACKGROUND OF THE INVENTION

This invention relates to a cross-water ski for walking on water. More particularly, this invention relates to a buoyant cross-water ski which, when used in a pair, enables a user to glide over the surface of a body of water.

Heretofore, there have been buoyant members or the like for walking on water. For example, U.S. Pat. Nos. 3,112,504; 3,134,114 and 3,242,898 show water walking devices each having a shoe connector that connects the front and rear portions of a user's shoe to the upper surface of a water walking member. In addition, the above-noted patents utilize flippers attached to the bottom surface of the water walking member as well as abutments positioned near each flipper to stop movement of the flipper when it reaches a position perpendicular to the bottom surface of the member whenever the member is moved in a rearward direction. Since the user's shoe is connected to the board at both its front and rear portions, a user must maintain his or her feet in parallel with the water surface at all times while walking on water. This requirement makes it difficult to adjust for losses in balance and thus creates a lack of stability in the water walking members. To offset this lack of stability, the water walking members can be made greater in width which provides for improved stability but makes it more burdensome and tiring on the user to use the heavier and more water resistant members. Moreover, the inability to flex one's feet while walking is unnatural and thus has a tendency to cause user discomfort.

U.S. Pat. No. 1,834,424 shows a user's shoe connected to a buoyant member by slipping the front portion of the user's shoe within a hood. However, in order to ensure that no slippage of the shoe takes place, the shoe is positioned deep within the hood. As a result, the user is unable to easily flex his or her feet resulting in a loss of stability and a decrease in comfort.

Further, U.S. Pat. No. 3,031,696 shows triangular shaped fins extending from the bottom of a water walking member to help stabilize the member. However, with respect to the structure of the fins, if the user skis above shallow water and any of the fins hit an obstacle the fin is likely to be broken.

SUMMARY OF THE INVENTION

An object of this invention, which has been made in view of the above-described circumstances of the prior art, is to provide a water ski which enables a user to quickly glide over a body of water in a comfortable and stable manner. A further object of this invention is to prevent obstacles located below the water surface from damaging the skis.

According to this invention, there is provided a cross-water ski for walking on water which is used in conjunction with a specially adapted shoe and pair of walking sticks. The cross-water ski includes a relatively small width buoyant member with hinged flaps provided on the bottom surface of the member. Preferably, the buoyant member includes a foam rubber body with a plurality of wood blocks disposed between two elongated strips of wood which extend longitudinally within the foam rubber body. Alternatively, the buoyant member may be formed of a lamination which includes wooden strips in addition to the strips positioned on each side of the wooden blocks. Preferably, the additional wooden strips are positioned between a plurality of styrofoam strips or similar lightweight buoyant material. The cross-water ski also includes stoppers positioned in front of each flap so as to stop the movement of the flaps when they reach a position perpendicular to the bottom surface of the buoyant member. In operation, the stoppers only stop movement of the flaps when the board is moved in a rearward direction.

The cross-water ski also includes a shoe connector which is provided on the upper surface of the member and includes a protrusion which is releasably connected to a recess formed in the front portion of the user's shoe. The cross-water ski further comprises at least one fin extending away from the bottom surface of the platform. The fin assists in stabilizing the board while in the water. The fin is also adapted to move whenever the fin comes in contact with an obstacle thus decreasing the chances of the fin becoming damaged.

The nature, utility, and further features of this invention will be understood from the following detailed description with respect to a preferred embodiment of the invention when read in conjunction with the accompanying drawings, briefly described below.

FIG. **6*a*** is a side elevational view of the fin of the present invention shown in normal operating position;

FIG. **6*b*** is a side elevational view of the fin of the present invention shown in an obstacle contact position;

FIG. 7 is a perspective view of the walking stick for use in the present invention;

FIG. **7*a* represents a close-up view of the circled portion of the stick in FIG. 7; and FIG. 8** is a somewhat schematic view illustrating the operation of the cross-water ski of the present invention.

DETAILED DESCRIPTION OF THE INVENTION

Figure 1:
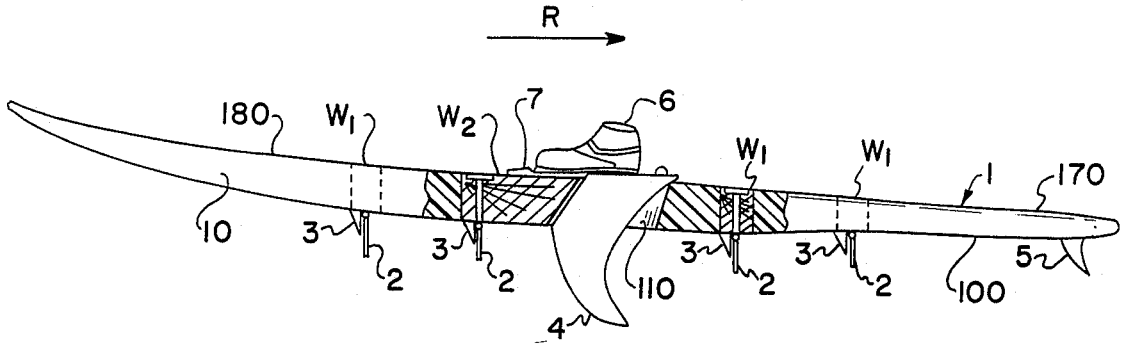
FIG. 1 is a side elevational view of the cross-water ski of the present invention with a portion broken away for clarity.
Figure 2:
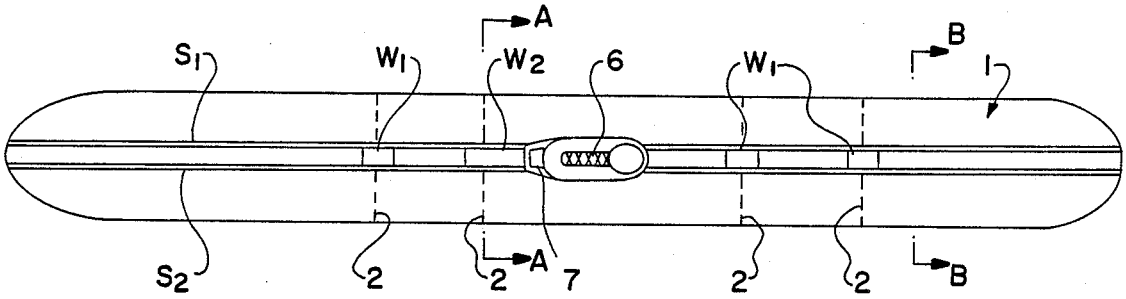
FIG. 2 is a top plan view of the cross-water ski of the present invention.
Figure 2B:
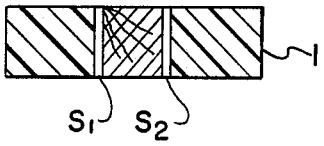
FIG. 2B is a cross-sectional view of FIG. 2 along line B—B.
Figure 2A:
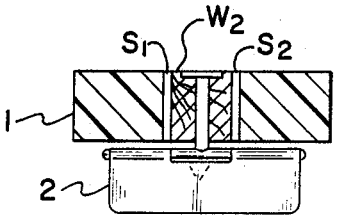
FIG. 2A is a cross-sectional view of FIG. 2 along line A—A.

Referring to FIGS. 1 and 2 of the drawings, numeral 1 depicts a cross-water ski of the present invention. Cross-water ski 1 includes buoyant member 10 and a plurality of flaps 2 pivotably hinged to bottom surface 100 of member 10. Cross-water ski 1 also includes stoppers 3 fastened securely to bottom surface 100 in a position to stop movement of flaps 2 when flaps 2 reach a position perpendicular to bottom surface 100. Flaps 2 pivot from a low water resistance position wherein flaps 2 are generally parallel with bottom surface 100 to a perpendicular high water resistance position whenever ski 1 moves in a rearward direction (denoted by arrow R in FIG. 1).

Main fin 4 is detachably positioned near the center portion of member 10 and extends below bottom surface 100. An auxiliary fin 5, which is smaller than main fin 4, is fixedly connected to bottom surface 100 at the rear end of member 10. Both fins 4 and 5 are made of plastic or vinyl and help in stabilizing member 10 while in the water.

FIG. 1 also illustrates shoe 6 which is suitable for attachment with the present invention. Attached to the upper surface of member 10 is foot piece 7 which releasably locks shoe 6 in place. The rear portion of shoe 6 is positioned above the upper surface of fin 4 which is located within recess 110 provided in member 10.

Member 10 is preferably formed entirely of foam rubber with the exception of areas of connection for flaps 2 and foot piece 7 and wood strips S1 and S2 (FIG. 2). As shown in FIG. 1, wood blocks W1 and W2 are provided in the areas of connection for foot piece 7 and flaps 2. In addition wood strips S1 and S2 extend the length of ski 1 as shown in FIG. 2. Strips S1 and S2 are spaced from one another by about the thickness of wood blocks W1 and W2 which in a preferred embodiment is 1.0 inch. Rather than foam rubber various other types of material that are lightweight and highly buoyant such as styrofoam with a plastic coating are also contemplated for use in the present invention. For added strength, member 10 can also be formed of a laminate wherein, in addition to wood strips S1 and S2, a further plurality of thin wood strips (not shown), extending the length of member 10 are interdisposed between a plurality of foam rubber or foam plastic strips (not shown) and coated with a suitable fiberglass or plastic material. FIG. 1 also illustrates that wood blocks W1 and W2 preferably extend for the entire height or thickness of member 10.

Figure 3:
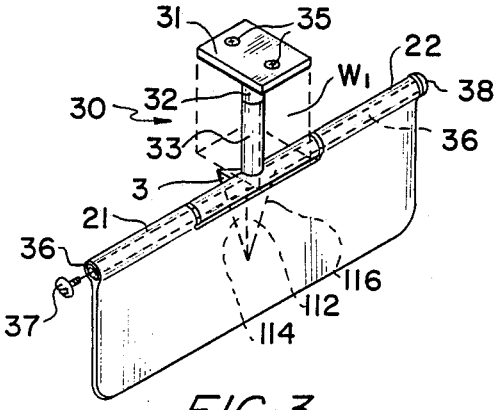
FIG. 3 is a perspective view of a flap of the present invention.

As shown in FIG. 3, flaps 2 are pivotably secured to a support device 30. Support device 30 includes plate 31, nut 32 rigidly attached to plate 31, vertical rod 33, horizontal hollow shaft 34, wood screws 35, shaft 36 and stopper bolt or plug 37. Shaft 36 includes head 38 integrally formed at one end thereof. Support device 30 is preferably formed of a metallic material which is protected from rusting either by utilizing a metallic material resistant to rusting or utilizing a rust resistant coating. Alternatively, support device 30 can be formed of a relatively hard plastic. Vertical rod 33 includes a threaded first end for threadably securing rod 33 within nut 32. The other end of vertical rod 33 is secured to horizontal shaft 34. Stopper 3 is rigidly secured to either horizontal shaft 34, vertical rod 33 or both. Stopper 3 is preferably pyramid shaped having a flat surface 112 and divergent sides 114, 116 which tend to reduce water resistance as member 10 is moved forward in the water. A bore is formed through each of wood blocks W1 so as to receive vertical rod 33 with a minimum amount of tolerance. Moreover, the threaded connection between vertical rod 33 and nut 32 allows for easy insertion and removal of support device 30 from member 10. Plate 31 is securely attached to wood block W1 with wood screws 35. FIG. 1 also illustrates the possibility of providing a flap 2 within the front portion of block W2. Upper surface 118 of stopper 3 is preferably co-planar with the lower bottom surface of block W1 (or W2) so as to increase stability of support 30 and also reduce water resistance.

Figure 3A:
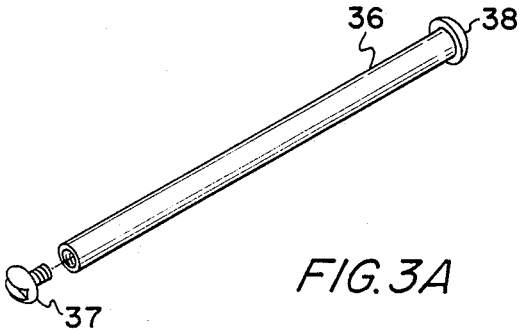
FIG. 3A is a perspective view of the hollow shaft forming part of the flap shown in FIG. 3.

Flap 2 is preferably made of plastic or metallic material and has a left hollow portion 21 and a right hollow portion 22 along its upper edge. A space is provided between left and right hollow portions 21 and 22 which is slightly longer than the length of horizontal hollow shaft 34 in order to accommodate shaft 34 within the space between left and right hollow portions 21 and 22. Shaft 36 passes through right hollow portion 22, horizontal hollow shaft 34 and left hollow portion 21. Stopper bolt 37 has a head which is of a larger diameter than the external diameter of hollow portions 21 and 22. Hence, when stopper bolt 37 is threadably received within the end of horizontal shaft 36, flap 2 is prevented from moving axially along shaft 36. FIG. 3A shows that shaft 36 has head 38 integrally formed at its end to prevent shifting of shaft 36 in the other direction.

Figure 4A:
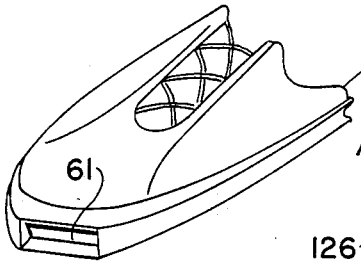
FIG. 4A is a perspective cut-away view of a suitable shoe for use with the present invention.
Figure 4:
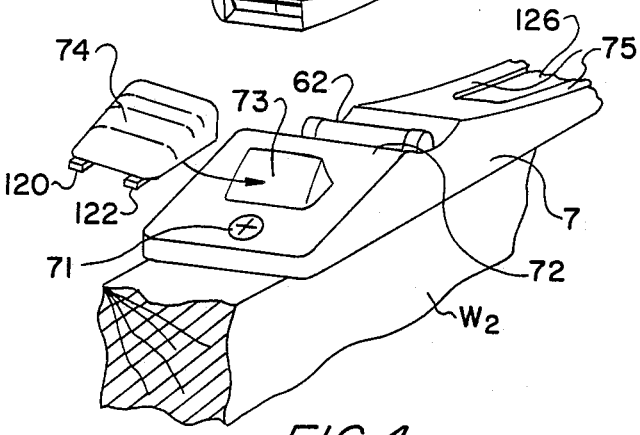
FIG. 4 is a perspective cut-away view of the foot piece of the present invention.
Figure 4B:
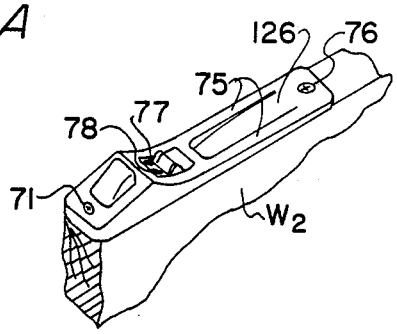
FIG. 4B is another perspective cut-away view of the foot piece of the present invention.

FIG. 4A shows a suitable shoe 6 for attachment with foot piece 7 of the present invention. As shown in FIG. 4, the foot piece 7 is connected to the upper surface of wood block W2 which is securely positioned within a recess formed in the foam rubber member 10. Foot piece 7 is rigidly secured between wood strips S1 and S2 to underlying wood block W2 with wood screws 71, 76, 77, 78 or any other suitable fastening means such as a water resilient adhesive or a combination of wood screws and adhesive. Foot piece 7 includes toe-iron 72 which releasably locks the forward end of shoe 6 to foot piece 7. Protrusion 62 forming part of toe-iron 72 (FIG. 4) is adapted for reception within recess 61 formed in shoe 6. Once protrusion 62 locks down the front end of shoe 6, the front end of shoe 6 is prevented from moving with respect to ski 1. However, the user is free to lift up the back end of his or her shoe and flex the foot in the same manner a person's foot is flexed while walking. Thus, the user is able to raise the heel of his or her foot to an angle of between about 15°–45° from the upper planar surface of the member 10—which is about the range of angles a person's heel would assume while normally walking.

Foot piece 7 further includes a release button 73 which, when depressed, provides for the automatic release of recess 61 from its locked position within toe-iron 72. The mechanism for moving toe-iron 72 into and out of locking position and the mechanism for effectuating release upon depression of release button 73 is generally known in the art and thus such mechanisms are not shown in detail. A suitable toe-iron for the purposes of this invention includes a foot-piece sold under the brand name of "Rottefella" manufactured by the New Nordic Norm Company. A boot brand compatible with the "Rottefella" foot-piece includes boots sold under the brand name "Artex."

To protect the internal mechanisms from water damage, cover 74 is positioned over toe-iron 72. Protective cover 74 includes tabs 120, 122, which are received within recesses (not shown) formed in raised portion 124 of foot piece 7. Toe-iron 72 includes protrusion 62 (FIG. 4) which is adapted for reception within recess 61 formed in shoe 6. Cover 74 is preferably formed of a rubber material.

FIG. 4 also illustrates foot piece 7 having two parallel rails 75 as well as recess 126 formed therebetween.

Figure 5:
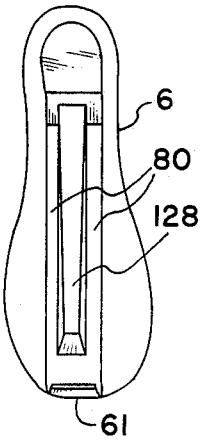
FIG. 5 is a bottom view of the shoe in FIG. 4A.
Figure 6A:
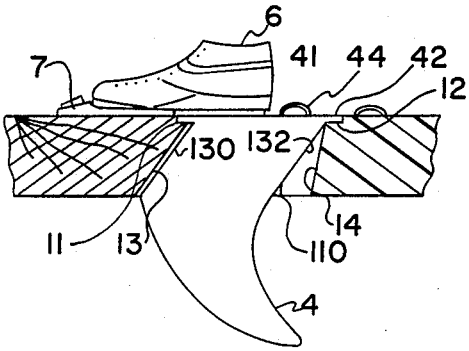
Figure 6B:
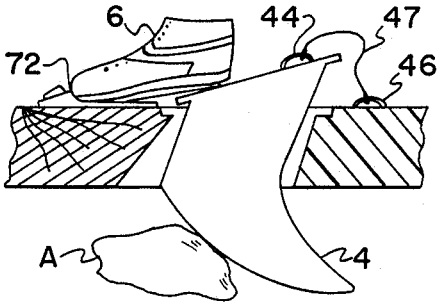

FIG. 5 shows the bottom of shoe 6 which includes raised portion 128 positioned between recesses 80 formed in the bottom surface of shoe 6. Rails 75 of foot piece 7 are received within recesses 80 so as to prevent undue lateral movement of shoe 6 with respect to foot piece 7. Shoe 6, however, is not prevented from rotating or flexing about toe-iron 72.

As shown in FIG. *6a*, recess 110 is formed directly behind foot piece 7. Recess 110 has a lateral width which is greater than that of the lateral width of fin 4. The rearward end of block W2 includes an inclined portion 13 which defines a forward portion of recess 110. Fin 4 includes a complementary inclined surface 130 and rear edge portion 132 which, when fin 4 is in its operating position, is spaced from inclined surface 14. Block W2 also includes recess 11 for reception of front extension 41 formed in fin 4. A similar recess 12 is formed in a foam rubber portion of member 10 and is positioned just rearwardly of inclined surface 14. Within recess 12 is positioned rear extension 42 of fin 4. Fin 4 is also dimensioned so as to be insertable between wood strips S1 and S2.

In normal operation, fin 4 is maintained in the position illustrated in FIG. *6a* with fin 4 retaining its position due to its own weight and the downward force applied by shoe 6 when shoe 6 is in an unflexed position. Finger loop 44 is provided on the upper surface of fin 4 in a position which is closer to rear extension 42 than front extension 11 so as to avoid making contact with shoe 6. Finger loop 44 is preferably formed of a short length of rope fastened by clamps or the like to the upper surface of fin 4. Finger loop 44 enables a user to easily remove fin 4 after use or insert fin 4 before use.

FIG. *6b* illustrates the manner in which fin 4 moves when it comes in contact with an obstacle such as rock A. When fin 4 comes in contact with rock A, fin 4 easily lifts upward in a pivoting motion within recess 110. As fin 4 moves upward, shoe 6 pivots or flexes counterclockwise about toe-iron 72. Movement of fin 4 thus prevents fin 4 from becoming easily broken. Also, the movement of fin 4 provides an early warning to the user that he or she is operating in shallow water. FIG. *6b* also illustrates the inclusion of an additional finger loop 46 as well as elastic extension cord 47. A combination of finger loops 44 and 46 as well as extension cord 47 ensures that fin 4 does not become disassociated from member 10.

FIGS. 7 and *7a* illustrate walking stick 8 which enhances user stability and helps a user force skis 1 forward. In addition, walking sticks 8 help the user turn on the water. Stick 8 is formed of a material which floats such as, for example, a light plastic or wood material. Wrist strap 81 is secured to the upper end of stick 8. At the other end of stick 8 is formed inverse V-shaped paddle blade 82 which includes forward portion 150 and rearward portion 162. The underlying surface of forward portion 150 provides a surface by which a user can push skis 1 forward against water resistance. In the event the user wishes to brake his or her forward movement, the underlying surface of rear portion 162 helps in achieving such a braking action. Also, by appropriate pushing and braking, walking sticks can be used to assist the user in making turns. Front portion 150 of each stick 8 is longer in length than rear portion 162 so as to avoid having rear portion 162 come in contact with the water as stick 8 is being swung rearwardly.

FIG. 8 illustrates a user person 160 utilizing a pair of skis 1 to glide over a body of water. User person 160 is also shown to be utilizing walking sticks 8. When user 160 moves his right foot rearwardly, flaps 2 of the right ski rotate about shaft 36 due to water resistance until they reach a respective stopper 3 which prevents flaps 2 from rotating beyond about 90°. With flap 2 in a perpendicular position a continued rearward pushing of member 10 enables the left ski to easily move forward with respect to the right ski. During the time the right ski is being pushed rearwardly, user 160 is able to lift the heel of his right back foot in a manner which increases stability and also comfort as it approaches normal walking movement. After the left ski is moved forward with respect to the more resistant right ski, user 160 can then begin to move left ski rearwardly so as to have flaps 2 move into perpendicular position which enables user 160 to move the right ski ahead of the left ski. Again, when moving the left ski rearwardly, user 160 can lift the heel of his left shoe while at the same time dropping his right shoe so as to enhance stability and comfort. Continuous movement of the left and right skis forward and rearward enables a user to quickly move across the upper surface of the water. Fins 4 and 5 help in preventing the skis from rotating about their longitudinal length which, if allowed, could result in user 160 falling into the water. Even if the user walks on waved water, the relatively narrow member 10 with its curved front end enables user 160 to cut through the waves while fins 4 and 5 assist in helping user 160 maintain his balance.

If the user were to ski into a shallow water region where fins 4 come in contact with the ground surface below the water, fins 4 would rotate upwardly and allow the user to pass through such a region. Also, if the user were to come in contact with a log or protruding object below the surface of the water, movement of fin 4 would help prevent any damage thereto. Upward movement of fin 4 is also easily detected by the user due to upward movement of shoe 6 and thus movement of fin 4 provides an early warning device to the user.

In a preferred embodiment of the invention the longitudinal length of member 10 is preferably about 7 to 11 feet and more preferably about 9 feet. The lateral width of member 10 is preferably about 10 to 16 inches and more preferably 13.5 inches. Preferred longitudinal length to lateral width ratios include ratios of between about 5:1 to 13:1 and more preferably 8:1. The maximum thickness of member 10 is preferably about 4 to 6 inches and the flaps extend about 5 inches below bottom surface 100 when in a perpendicular position. Member 10 is also preferably formed to have a thickness which is greatest in its mid-region but gradually decreases until bottom surface 100 and upper surface 170 come together at the forward and rearward ends of member 10. In addition, front portion 180 of member 10 also preferably curves upwardly from the horizontal to assist in gliding over relatively rough water surface. Fin 4 is preferably about 16 inches in vertical length which means that for a central thickness of about 5 inches for member 10, fin 4 extends below bottom surface 100 for about 11 inches. The 9 feet length and 13.5 inch lateral width is particularly well suited to support a person 6 feet tall and weighing 180 pounds. Variations in the size of the skis are possible for matching the size of the skis with the user. For instance, smaller sized skis for children are possible. The present invention provides an exercise device which enhances the muscular, respiratory and cardiovascular system and, at the same time, allows a user to enjoy his or her aquatic surrounds. Moreover, the present invention provides a means of transportation as well as a device which can be used in races and other competitions.

While there has been shown and described preferred forms of the invention, it is to be understood that the invention is not necessarily confined thereto, and that any change or any changes in the structure of and in the relative arrangements of components thereof are contemplated to be within the scope of the invention as defined by the claims appended hereto.

What is claimed is:

1. A cross-water ski for walking on water, comprising:

a buoyant member having an upper surface, a bottom surface, a front end, and a rear end;

a flap rotatably secured to the bottom surface of said buoyant member, said flap adapted to rotate from a first position of low water resistance to a second position of higher water resistance;

stopper means for preventing further rotation of said flap when said flap reaches said second position; and shoe connecting means positioned on the upper surface of said buoyant member for connection with a shoe being worn by a user with a shoe having a forwardmost portion extending into two exterior side portions which in turn extend into a rear portion, said shoe connecting means including shoe locking means for releasably locking only the forwardmost portion of the shoe such that the two exterior side portions of the shoe are essentially free from attachment with said shoe connecting means and said shoe is detachable from said buoyant member upon a release of said locking means.

2. A cross-water ski according to claim 1, further comprising a first fin extending from the upper surface of said buoyant member, through a recess in said buoyant member, and to a position below the bottom surface of said buoyant member.

3. A cross-water ski according to claim 2, wherein said first fin is detachably positioned within the recess in said buoyant member and is free to move upwardly within the recess upon contact with an obstacle.

4. A cross-water ski according to claim 3, wherein said fin is positioned rearward of said shoe locking means such that the rear end of the shoe of the user rests on an upper surface of said fin when said fin is in a normal operating position free of any contact with an obstacle.

5. A cross-water ski according to claim 4, wherein said first fin includes flanges, and depressions are formed in the upper surface of said buoyant member for receipt of said flanges.

6. A cross-water ski according to claim 2, further comprising a second fin attached to the bottom surface and at the rear end of said buoyant member.

7. A cross-water ski according to claim 1, wherein said locking means includes a protrusion adapted for reception within a recess formed in the forwardmost portion of the shoe.

8. A cross-water ski according to claim 7, further comprising releasing means for effectuating an automatic release of the shoe from said locking means.

9. A cross-water ski according to claim 7, further comprising covering means for covering said shoe locking means so as to protect said shoe locking means from contact with water.

10. A cross-water ski according to claim 7, wherein said foot piece further includes parallel spaced rails extending rearwardly away from said shoe locking means, said rails each adapted for engagement within a recess formed in the shoe such that, when the shoe is in contact with said foot piece, said rail prevents lateral movement of the shoe with respect to said foot piece.

11. A cross-water ski according to claim 1, wherein said buoyant member is comprised of a foam rubber body with wood blocks disposed between two elongated strips positioned within said foam rubber body.

12. A cross-water ski according to claim 1, wherein the length to width ratio of said buoyant member is about 8:1.

13. A cross-water ski according to claim 1, wherein said buoyant member includes an upwardly curved front portion and a thickness which gradually decreases from a mid-portion of said buoyant member towards both the front and rear ends of said buoyant member.

14. A cross-water ski according to claim 1, wherein said shoe connecting means connects the shoe of a user such that the bottom of the shoe of the user is free to form an angle of between 15° to 45° with respect to a planar surface contiguous with a mid-portion of the upper surface of said buoyant member and the shoe is free to pivot solely about the forwardmost portion of the shoe in attachment with said shoe locking means.

15. A cross-water ski according to claim 1, wherein said buoyant member includes a laminated body comprising a plurality of elongated wood strips spaced between a plurality of styrofoam strips and said laminated body having a water impermeable coating.

16. A cross-water ski for walking on water, comprising:

a buoyant member having an upper surface and a bottom surface;

a flap rotatably secured to the bottom surface of said buoyant member;

stopper means for preventing rotation of said flap when said flap is essentially perpendicular to the bottom surface of said buoyant member; and shoe connecting means for releasably connecting a shoe being worn by a user to said buoyant member so as to allow for repeated flexing of the foot of the user from a first position wherein the bottom surface of the foot of the user is essentially parallel with the upper surface of said buoyant member to a second position wherein the bottom of the foot of the user assumes an angle of about 15° to 45° with respect to the upper surface of the buoyant member and the shoe having a forwardmost portion extending into two exterior side portions that extend into a rear portion and said shoe connecting means including shoe locking means for releasably locking only the forwardmost portion of the shoe such that the two exterior side portions of the shoe are essentially free from attachment with said shoe connecting means and the shoe is detachable from said buoyant member upon a release of said locking means.

17. A cross-water ski according to claim 16, further comprising a detachable fin extending from the upper surface of said buoyant member, through a recess in said buoyant member, and to a position below the bottom surface of said buoyant member and said fin having an upper surface which is essentially coplanar with the upper surface of said buoyant member and adapted to come in contact with the shoe of a user.

18. A cross-water ski package, comprising: a pair of cross-water skis each of which includes:

(a) a buoyant member having an upper surface and a bottom surface;

(b) a flap rotatably secured to the bottom surface of said buoyant member;

(c) stopper means for preventing rotation of said flap when said flap is essentially perpendicular to the bottom surface of said buoyant member; and (d) shoe connecting means for releasably connecting a shoe of the user to said buoyant member;

a pair of cross water ski poles having a shaft with an inverse V-shaped paddle attached to one end of said shaft; and a pair of cross-water ski shoes each having a forwardmost portion extending into two exterior side portions that extend into a rear portion, said shoes including attachment means formed at the forwardmost portion, and said shoe connecting means including shoe locking means dimensioned and arranged to releasably lock solely said attachment means such that the two exterior side portions of said shoe and the rear portion are free from attachment with said shoe connecting means.

19. A cross-water ski package according to claim 18, wherein said attachment means includes a recess formed in the forwardmost portion of each of said shoes and said shoe locking means including a pivotable protrusion designed for insertion into said recess and adapted to pivot into a fixed position which clamps the forwardmost portion of the shoe against said shoe connecting means.

20. A cross-water ski for walking on water, comprising:

a buoyant member having an upper surface, a bottom surface, a front end, and a rear end;

a flap rotatably secured to the bottom surface of said buoyant member, said flap adapted to rotate from a first position of low water resistance to a second position of higher water resistance;

stopper means for preventing further rotation of said flap when said flap reaches said second position;

shoe connecting means positioned on the upper surface of said buoyant member for connection with a shoe of a user so as to allow for repeated flexing of the foot of the user during operation of the ski whereby the heel of the foot of the user is free to rotate off of said shoe connecting means; and a fin extending from the upper surface of said buoyant member, through a recess in said buoyant member, and to a position below the bottom surface of said buoyant member, said fin being detachably positioned within the recess and free to move upwardly upon contact with an obstacle, and said fin being positioned rearward of said shoe connecting means such that the rear end of the shoe of the user, when in an unflexed position, rests on an upper surface of said fin.

21. A cross-water ski according to claim 20, wherein said fin includes flanges, and depressions are formed in the upper surface of said buoyant member for receipt of said flanges.

* * * * *